US005722562A

United States Patent [19]

Kick

[11] Patent Number: 5,722,562

[45] Date of Patent: Mar. 3, 1998

[54] TUBE CAP

[75] Inventor: James Kick, Town and Country, Mo.

[73] Assignee: C.A.P.S. Inc., Bridgeton, Mo.

[21] Appl. No.: 623,249

[22] Filed: Mar. 28, 1996

[51] Int. Cl.[6] ..... B65D 41/16

[52] U.S. Cl. ..... 220/785; 220/792; 220/802; 220/366.1; 215/320

[58] Field of Search ..... 220/203.01, 203.11, 220/366.1, 785, 792, 802; 215/307, 320

[56] References Cited

U.S. PATENT DOCUMENTS

| | | | |
|---|---|---|---|
| 3,028,039 | 4/1962 | Clark | 220/366.1 |
| 3,216,148 | 11/1965 | Amberg | 220/785 X |
| 3,672,536 | 6/1972 | Kinney et al. | 220/785 X |
| 3,809,280 | 5/1974 | Park et al. . | |
| 4,234,100 | 11/1980 | Chabot | 220/366.1 X |
| 4,390,113 | 6/1983 | Bird | 220/785 X |

*Primary Examiner*—Stephen Cronin
*Attorney, Agent, or Firm*—Polster, Lieder, Woodruff & Lucchesi

[57] ABSTRACT

A closure cap (1) of the present invention is provided for closing a tube (3). The cap has a skirt (15) which, when installed on the tube, extends from the end of the tube along the outside of the outside surface of the tube wall, an end closure (13) which extends across the end of the tube and closes off the end of the tube, and an inner flange (17) integral with the skirt and with the end closure. The inner flange is concentric with the skirt such that the end of the tube is received between the skirt and the inner flange. The cap further has a wall (19) integral with the inner end of the flange and integral with the end closure for connecting the inner end of the inner flange and the end closure. A flexible connection (23) is provided between the skirt and the inner flange which permits flexing of the inner flange relative to the skirt upon installation of the cap on the tube thereby to enable installation of the cap on the tube substantially without deformation of the tube. The wall and the end closure apply a radially outward biasing force on the inner flange thereby to grip the tube between the inner flange and the skirt so as to hold the cap on the tube.

5 Claims, 1 Drawing Sheet

TUBE CAP

BACKGROUND OF THE INVENTION

This invention relates to a cap for a tube filled with a material to protect and to enclose the material after packaging and prior to use. More specifically, this invention relates to a cap applied to one or to both ends of a paperboard tube filled with lubricating grease, caulking compound, or the like to enclose the grease within the tube after filling and prior to use where the cap(s) are removed from the tube immediately prior to insertion of the tube into a dispensing gun or the like.

In the packaging of grease, the grease is often heated to about 140°–150° F. so that the grease will readily flow into a tube for ease of filling. The tube is typically of a spiral wound paperboard tube impregnated with wax or the like to prevent the grease from soaking through the paperboard. Often, the tube has have an inner liner of metal foil or the like to provide a liquid barrier for the contents of the tube and the tube has an outer liner for decorative purposes which may be imprinted with high quality graphics or the like. After the tube is filled with grease, a molded plastic cap is applied to one or both ends of the tube thereby to enclose the grease within the tube to protect the grease during shipping and storage prior to use. Immediately prior to use, the cap(s) are removed and discarded. An example of such a prior art tube cap is shown in U.S. Pat. No. 3,809,280.

Such prior art tube caps typically have a flat end extending diametrically across the open end of the tube and an outer flange or skirt which extends axially from the outer face along the outside cylindrical surface of the tube a distance for a distance of about one-half inch (12.5 mm.) or so from the end of the tube. The cap may further have an inner flange on the inside of the face flat end arranged concentrically with respect to the outer skirt with a gap between the inner face of the outer skirt and the outer face of the inner flange which is somewhat thinner than the thickness of the wall of the tube. The inner flange is shorter than the outer skirt, and may have a taper on its outer face that upon application of the cap on the end of the tube, a wedging action takes place as the cap is pressed onto the end of the tube to insure that the tube is firmly gripped between the skirt and the flange.

Conventionally, such prior art tube caps are applied on a high speed tube filling line by placing the cap on the end of the tube after the tube has been filled at an angle with respect to the end of the tube with the skirt fully on the tube at the "lower" side of the angled cap and with the edge of the skirt on the higher side just bearing on the end of the tube. As the tube moves down a conveyor, the cap is engaged by a roller or the like which forces (rotates) the cap onto the end of the tube.

While this cap applying process works well, it is not without problems. As noted, the cap is first installed on the end of the tube at angle and then is forcefully rolled onto the tube such that the end of the cap is generally perpendicular to the centerline of the tube. This rolling action causes the inside face of the cap skirt on the low side of the cap to press inwardly on the side of the tube and causes the inside face of the cap skirt on the high side of the tube tends to force the outer edge of the tube inwardly. This inward application of force on the tube may cause deformation or denting of the tube, particularly where the tube has been softened by heated grease or the like packed within the tube. Further, such wedging action, due to the tapered face of the inner flange, may cause excessive compression loading of the tube as the cap is rolled into place. This excessive compressive loading may cause local buckling of the tube particularly where the tube may be weakened due to the heated contents of the tube. Of course, if such denting or buckling of the tube results from applying the cap to the tube, the cap may not properly seal the tube and grease may leak from the tube during shipping or storage with may mar the package and others packed with it. In certain instances, such denting may prevent the tube from functioning properly once it is inserted within a grease gun or the like.

Still further, rolling of the cap onto the tube causes the outer end portion of the tube to enter the space between the inner and outer flanges such that the tube is gripped therebetween. In certain prior art caps, the outer face of the inner flange tapers outwardly so that as the cap is installed on the tube, the tapered outer surface exerts a wedging action on the tube to aid in the cap being gripped by the tube. However, with certain prior art caps, it has been noted that, over time, the gripping force of the cap may relax such that the cap will become dislodged from the tube during normal shipping prior to use. It will be recognized, however, that while it is desirable that the cap firmly grip the end of the tube, it is necessary that the cap be readily removed from the tube when the end user wants to use the contents of the tube.

Another problem encountered when such prior art caps are applied to the tube is that as the cap is rapidly applied to the end of the tube, air becomes entrapped within the end portion of the tube and this air may be under some positive pressure. With the tube still in a softened condition, as above described, this positive air pressure has been noted to at least partially push the cap off the end of the tube which can result in leaking of the grease.

SUMMARY OF THE INVENTION

Among the several objects and features of the present invention may be noted the provision of a cap for closing the open end of a tube container, such as a grease tube, which is significantly easier (i.e., requires less force) to install on the end of such a tube and yet which has enhanced gripping force on the tube, as compared with prior art tube caps;

The provision of such a cap, which when applied at an angle and which when rolled onto the end of a tube readily resiliently deforms in certain selected areas so as to lessen the tendency of the application of the cap on the tube to deform or buckle the end of the tube, even when applied to paperboard tubes which have been filled with heated grease or the like;

The provision of such a cap which, when installed, resiliently grips the tube in such matter that the resilient gripping action of the cap does not tend to relax after a period of time thereby to provide for enhanced gripping of the tube, and yet, upon removal, permits the ready removal of the cap from the tube;

The provision of such a cap which has one or more flexible hinge connections between the end closure of the cap and the skirt so as to enable ease of installation of the cap on the tube so as to have an enhanced resilient gripping of the tube end;

The provision of such a cap which has grooves or passages leading from the inside face of the cap around the portion of the cap receiving the end of the tube and along the inside face of the cap skirt to permit air to be vented from within the tube as the cap is installed on the end of the tube; and, The provision of such a cap which is economical to manufacture, which reliably closes and seals the ends of the tube, which may be applied with by conventional cap filling lines, and which is easy to remove by the end-user.

Briefly stated, this invention relates to a closure cap for a tube. The tube has a tubular wall having an outer surface, an inner surface, and a tube end. The cap has a skirt which, when installed on the tube, extends from the end of the tube along the outside of the outer surface of the tube wall, and an end closure which extends across the end of the tube and closes off the end of the tube. The cap further has a flange integral with the skirt and with the end closure. This flange extends axially from the end closure so as to be disposed on the inner face of the tube generally concentric with the flange when the cap is installed on the tube such that an end portion of the tube gripped between the inner wall of the skirt and the outer wall of the flange. The cap further has a wall integral with the inner end of the flange and integral with the end closure for connecting the inner end of the flange and the end closure. A flexible connection or hinge is provided between the skirt and the flange which permits flexing of the flange relative to the skirt upon installation of the cap on the tube thereby to enable installation of the closure on the tube substantially without deformation of the tube end and which applies a radially outward force on the flange thereby to force the outer face of the flange against the inner face of the tube so as to enhance gripping of the tube and so as to resist removal of the cap from the tube end with more force that was required to install the cap on the tube.

Other objects and features of this invention will be in part apparent and in part pointed out hereinafter.

BRIEF DESCRIPTION OF THE DRAWINGS

Corresponding reference characters indicate corresponding parts throughout the several view of the drawings.

DESCRIPTION OF A PREFERRED EMBODIMENT

Figure 1:
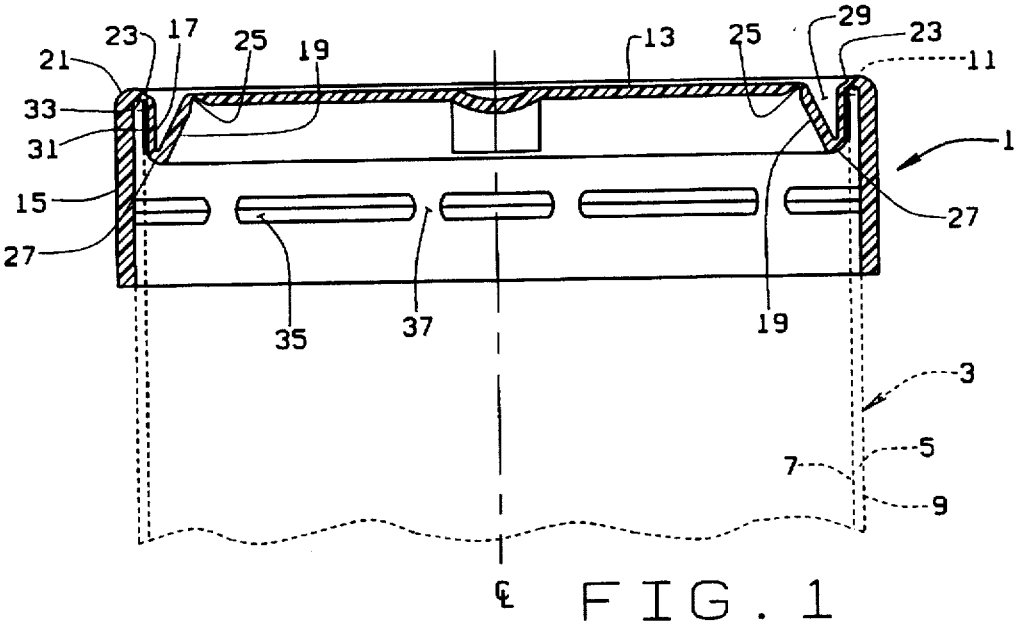
FIG. 1 is an enlarged cross sectional view of a cap of the present invention installed on a tube for closing the open end of the tube with the tube being shown in phantom.

Referring now to the drawings, and particularly to FIG. 1, a cap of the present invention is indicated in its entirety by reference character 1 for closing the open end of a tube, as generally indicated at 3, shown in phantom. Preferably, tube 3 is a cylindrical tube having a circular cross section. The tube may have an outer diameter of about 2⅛ inches (5.4 cm.) and a length of about 8–12 inches (20–30 cm.). The tube has a tube wall 5 which in turn has an inner tube surface 7 and outer tube surface 9 and a tube end or edge 11. Tube 3 may, for example, be of spiral wound paper board construction and it may have inner and outer liners (not shown). However, the construction of tube 3 is not important to the cap 1 of the present invention and thus cap 1 may be used with various tubes including extruded plastic tubes or formed metal tubes.

Cap 1 is preferably a one piece member molded of a suitable plastic resin, such as polypropylene or high density polyethylene (HDPE) or the like. While any number of resins may be used, various polypropylene resins commercially available from Fina work well. The cap has an end closure or end plate 13 which extends generally diametrically across the tube and which is disposed so as to be generally perpendicular to the longitudinal axis of the tube. The cap has an outer skirt or flange 15 which, when the cap is applied on the tube, extends along the outside wall of the tube a distance of approximately ½ inch (1.3 cm.). As shown in FIG. 1, the cap has an inner cap flange 17 integral with cap skirt 15 and integral with cap end closure 13. This inner cap flange 17 is spaced concentrically around the outside of cap end closure 13 and is spaced radially inwardly from cap skirt 15 so as to snugly receive tube wall 5 between the inner face of skirt 15 and the outer face of flange 17. An angled wall 19 is integral with and extends between the inner most end of wall 17 and the outer most edge of cap end closure 13. A transition shoulder 21 is provided between the base of skirt 15 and the upper end of flange 17 with the inside face of the transition shoulder being adapted to engage end 11 of tube 3 when the cap is fully seated on the end of the tube.

A first flexible connection 23 may be provided between the upper end of inner cap flange 17 and transition shoulder 21 so as to permit skirt 15 to resiliently bend or flex radially inwardly and outwardly relative to flange 17 upon installation of the cap on the end of tube 3 and so as to permit inner flange 17 to flex radially inwardly about the flexible connection toward the center of the cap so that the space between the inner face of skirt 15 and the outer face of inner flange 17 will readily widen to accept tube wall 5 as the cap is installed on the end of the tube. Further, a second integral flexible connection 25 may be provided between the upper end of angled wall 19 and the outer margin of end closure 13 so as to enable the angled wall to readily flex or bend relative to end closure 13. It will be appreciated that the two flexible connections 23 and 25, angled wall 19, and integral flange 17 decouple end closure 13 from skirt 15 and from inner flange 17 so as to permit the ready flexing of the caps and to thus lessen the application of forces on the tube upon installation of cap 1 of the present invention on to the end of the tube. This lessening of the forces applied to the tube results in less of a tendency of the cap of the present invention to dent, buckle or otherwise deform the end of the tube during installation of the cap which in turn minimizes the tendency of the tube with cap 1 of the present invention applied thereto to leak during storage and transit.

Preferably, but not necessarily, flexible connections 23 and 25 are molded-in-place hinges to facilitate flexing or bending of the parts of cap 1 connected to the hinges. However, in caps of the present invention, which do not, per se, have such molded-in-place hinges, those skilled in the art will recognize that, due to the design of cap 1 and due to the various types of plastic resin from which cap 1 may be molded, flexing or bending between the outer end of inner flange 17 and transition shoulder 21 will occur at approximately the location of connection 23. Likewise, even without the presence of a molded-in-place hinge, flexing or bending will occur between the outer margin of end closure 13 and the upper end of angled wall 19 at the location of the second flexible connection. It will also be understood that, within the broader aspects of this invention, that while both of the above-described flexible connections are preferred, both flexible connections are not required.

As indicated at 27, an integral joint is provided between the lower ends of inner flange 17 and angled wall 19 so as to establish a substantially fixed angle therebetween. However, it will be appreciated that because cap 1 is molded of a flexible or resilient material, such as high density polyethylene (HDPE) or the like, if angled wall 19 and inner flange 17 are flexed toward or away from one another so as to change the angle therebetween, the fixed angle 27 serves as a resilient spring which will bias inner flange 17 and wall 19 to return to their "as molded" position or angle. Thus with cap 1 installed on the end of the tube, the insertion of the tube wall 5 between the inner face of skirt 15 and the outer face of inner flange 17 tends to flex the inner flange away from the skirt and toward angled wall 19. However, the resilient spring action of the inner flange 17 and angled wall 19 tends to constantly force or bias inner flange outwardly toward skirt 15 and to thus apply a resilient gripping force on tube wall 5 thereby to aid in retaining the cap on the tube. It will further be appreciated that this resilient flexing nature of inner flange 17 permits the inner flange to accommodate dimensional variations in both the thickness of wall 5 of the tube and any minor deformations of the tube and yet to maintain a firm gripping and sealing relationship between inner flange 17 and the inner face of the tube wall 7.

Still further, inner flange 17 and the angled wall 19 with the fixed angle 27 therebetween forms a generally V-shaped groove, as indicated at 29, on the exterior of cap 1 which extends concentrically around the outer margin of cap end closure 13 so as to structurally decouple the end closure from skirt 15. This groove, in combination with flexible connections 23 and 25, allows the inner flange 17 and skirt 15 to readily flex relative to one another and relative to end closure 13.

In order to allow air to escape from within tube 3 upon application of cap 1 on a tube 3, a plurality of grooves or channels 31 (see FIG. 1) are molded into the outside face of inner flange 17. As shown, there are four such channels 31 provided, but any desired member of channels may be provided. Cooperating with axial grooves or channels 31, passages 33 are provided on the inside face of transition shoulder 21 to allow the escaping air to flow around and past the edge 11 of the end of the tube when the cap is installed on the end of the tube. These passages 33 are in register with axial grooves 31 and thus prevent the blocking of the air vented from within the tube by the edge of the cap which may sealingly engage the inside face of transition shoulder 21. As indicated at 35, a plurality of circumferential tube gripping ribs are provided on the inside face of skirt 15 to aid in gripping the cap to the outer surface of the tube. Six of these gripping ribs are shown to be provided on the inside face of the skirt at generally equal angular intervals around the cap and, as indicated at 37, gaps are provided between the adjacent end of the ribs to allow air from within the tube to be vented to the atmosphere.

Figure 2:
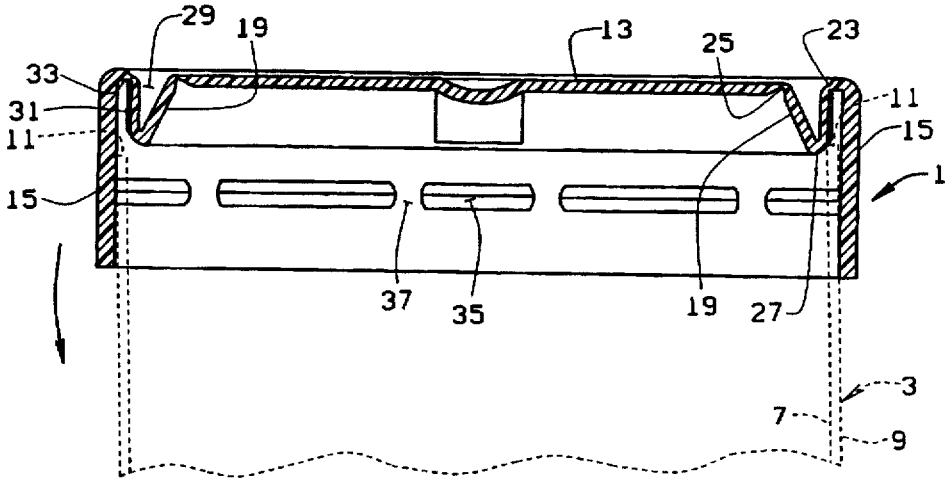
FIG. 2 is a view similar to FIG. 1 illustrating the installation of a cap of the present invention as it is installed onto the end of a tube with the cap being disposed at an angle with respect to the tube.
Figure 3:
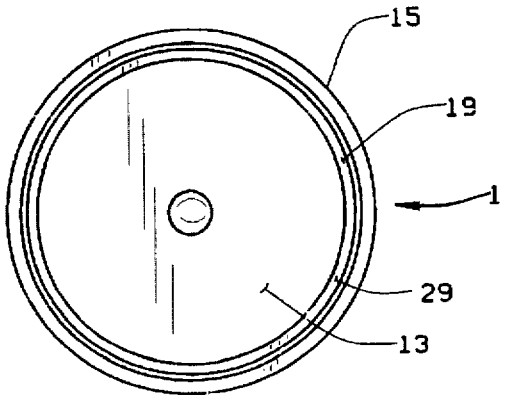
FIG. 3 is a top plan view of the cap on a reduced scale.

In use, after tube 3 has been filled, cap 1 of the present invention may be installed with conventional cap installation production equipment in which the cap is first placed on the tube at an angle, as illustrated in FIG. 2. The tube with cap 1 so initially positioned then is forcibly rolled onto the end of the tube by conventional cap installation rollers (not shown) such as are typically employed in many tube filling lines so that the cap is rotated from its initially installed, angled position (as shown in FIG. 2) to assume its installed position, as generally shown in FIG. 1.

It will be appreciated that due to the flexible connections or hinges 23 and 25, due to the V-shaped groove 29, and due to the resilient nature of the molded inner flange 17 and the angled wall 19, a substantial amount of flexing between skirt 15 and inner flange 17 and between the inner flange and the skirt relative to the end closure 13 is permitted during the rolling installation of the cap onto the tube without exerting excessive deformation forces on the tube. This allows cap 1 of the present invention to be installed on the tube without exerting such excessive deformation forces on the tube, particularly such tubes as may be in a softened condition due to the heated contents of the tube. It will be further appreciated that because of the resilient nature of the spring like action of angled wall 19 and inner flange 17 and the fixed angle 27 therebetween, a resilient gripping action is applied to inner flange 17 which in turn exerts a resilient gripping force on the tube end gripped between inner flange 17 and skirt 15. This resilient spring action of the inner flange 17 allows the end of the tube to be fully inserted into the tube receiving groove between skirt 15 and flange 17 without the requirement of applying excessive axial loads to the end of the tube which may result in deformation of the end of the tube.

More specifically, it will be appreciated that in some prior art caps where the inner flange is rigidly fixed with respect to the outer skirt and to the end closure, and particularly where the outer face of the inner flange (or the inner face of the skirt) is beveled so as to compressively wedge the tube wall between the skirt and the inner flange as the cap is installed, such cap constructions may exert high compressive local loading on the cap wall which can cause local buckling or deformation of the tube wall. However, cap 1 of the present invention, with the flexible connections between the inner flange 17 and skirt 15, and with the provision of angled wall 19 and groove 29, the resilient spring action of inner flange 17 (as above described) permits the inner flange to flex inwardly to readily receive the tube wall without applying such excessive compressive forces to the tube, and yet this spring-like action of the inner flange to be biased back to its molded position is sufficient to firmly grip the tube wall between skirt 15 and the inner flange. This lower compressive loading of the tube end diminishes damage to the tube end and results in fewer leaking tubes when cap 1 of the present invention is used.

It will further be appreciated that due to the flexible hinge connections 23 and 25 and due to the spring action of the integral flange 17 and angled wall 19, and due to the ready deformation of the skirt 15 away from the outer face of the tube cap 1 may be readily removed from the tube with a lower removal force than prior art caps. In this manner, ease of installation and removal of the cap of the present invention is possible while, with the resilient gripping action of the inner flange 17 and outer skirt 15 providing enhanced retention forces for the cap on the tube.

In view of the above, it will be seen that the several objects and features of this invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A closure cap for a tube, said tube having a tube wall and a tube end, said tube end being of a single thickness of said tube wall, said cap comprising a skirt which, when installed on said tube, extends from the end of said tube along the outside of said tube wall and is substantially in face-to-face engagement with the outer surface of said tube wall, said cap further having an end closure which extends across the end of the tube and closes off the tube, an inner flange integral with said skirt and with said end closure, said inner flange being concentric with said skirt and being substantially parallel to said skirt so as to receive said single thickness of said tube wall therebetween, a wall integral with the inner end of said inner flange and integral with said end closure for connecting the inner end of said inner flange and said end closure, and a flexible connection between said skirt and said inner flange which permits flexing of said inner flange relative to said skirt upon installation of said cap on said tube thereby to enable installation of said cap on said tube substantially without deformation of said tube, said wall applying a radially outward biasing force on said inner flange thereby to grip said tube between said inner flange and said skirt so as to hold said cap on said tube.

2. A cap as set forth in claim 1 having a second flexible connection between said wall and said end closure so as to permit the ready flexing of said wall relative to said end closure.

3. A cap as set forth in claim 1 having means for venting air entrapped within said tube upon installation of said cap on said tube.

4. A cap as set forth in claim 3 wherein said means for venting air comprises passages on the outer face of said inner flange, around the end of said tube received between said inner flange and said skirt, and on the inner face of said skirt.

5. A one-piece closure cap for a tube, said tube having a tube wall and a tube end, said tube end being of a single thickness of said tube wall, said cap comprising a skirt which, when installed on said tube, extends in axial direction relative to said tube from the end of said tube along the outside surface of said tube wall, an end closure which extends across the end of the tube and closes off the end of the tube, an inner flange integral with said skirt and with said end closure, said inner flange being concentric with said skirt and extending axially of said tube along the inside surface of said tube wall so as to receive and to grip said single thickness of said tube wall between said inner flange and said skirt, and a wall integral with the inner end of said inner flange and integral with said end closure for connecting the inner end of said inner flange and said end closure, said wall being angled radially inwardly from the inner end of said inner flange toward said end closure thereby to define a groove between the outer margin of said end closure and said inner flange with the latter constituting the outer portion of said groove and with said wall constituting the inner portion of said groove, a flexible connection between the bottom of said wall and said inner flange, said flexible connection substantially decoupling said inner flange and said skirt from said end closure such that said inner flange and said skirt may deform substantially independently of said end closure upon installation of said cap on said tube.

* * * * *